United States Patent [19]

Narita et al.

[11] 4,298,376

[45] Nov. 3, 1981

[54] METHOD FOR TREATING MOLTEN STEEL AND APPARATUS THEREFOR

[75] Inventors: Kiichi Narita, Kobe; Takasuke Mori, Ashiya; Kenzo Ayata; Takehisa Makino, both of Kobe, all of Japan

[73] Assignee: Kobe Steel, Ltd., Kobe, Japan

[21] Appl. No.: 139,655

[22] Filed: Apr. 14, 1980

[51] Int. Cl.[3] ..... C21C 7/10

[52] U.S. Cl. ..... 75/49; 266/207; 266/209

[58] Field of Search ..... 75/49; 266/207–212

[56] References Cited

U.S. PATENT DOCUMENTS

| | | | |
|---|---|---|---|
| 3,212,767 | 10/1965 | Muller | 75/49 |
| 3,737,302 | 6/1973 | Pomey | 75/49 |
| 3,798,025 | 3/1974 | Ramachandran | 75/49 |

OTHER PUBLICATIONS

Winkler & Bakish, "Vacuum Metallurgy", p. 412 (Elsevier Publishing Co. 1971).

*Primary Examiner*—P. D. Rosenberg

*Attorney, Agent, or Firm*—Oblon, Fisher, Spivak, McClelland & Maier

[57] ABSTRACT

A method for treating molten steel utilizing an induction coil, a ladle, a treating vessel and at least one passage pipe interconnecting the ladle and the treating vessel which includes the steps of lifting up a part of the molten steel from the ladle to the treating vessel disposed over the ladle through adjustment of molten steel composition and/or degassing in the treating vessel, thereafter returning the molten steel to the ladle through the at least one passage pipe, circulating or reciprocating the molten steel between the ladle and the treating vessel while heating the molten steel by the induction coil disposed around the at least one passage pipe and operating the linear motor at a frequency of 50 to 60 cycles.

10 Claims, 6 Drawing Figures

METHOD FOR TREATING MOLTEN STEEL AND APPARATUS THEREFOR

FIELD OF THE INVENTION

The present invention relates to a method and apparatus for the treatment of molten steel such as an adjustment of molten steel composition and a vacuum degassing of molten steel. More particularly, the present invention relates to a method and apparatus for improving the efficiency of treating molten steel upon circulating or reciprocating molten steel through at least one passage pipe between a ladle and a treating vessel, and subjecting molten steel to the adjustment of molten steel composition and/or degassing in the treating vessel.

BACKGROUND OF THE INVENTION

At present, an RH or DH method is generally adopted for degassing or adjustment of molten steel composition. FIG. 1 shows an embodiment of the RH method. A treating method by use of an apparatus as shown in FIG. 1 is explained hereinafter.

Denoted as numerals 1, 2, 3, 4, 5, 6 and 7 are a ladle, a mixing vessel, a molten steel ascending pipe, a molten steel descending pipe, an inert gas (in general, Ar) feeding pipe, a vacuum suction port and an alloy element containing vessel, respectively. Denoted as A and B are molten steel and alloy elements. When a method by use of the apparatus as shown in FIG. 1 is performed, the mixing vessel 2 is disposed over the ladle 1, both the ascending pipe 3 and the descending pipe 4 are dipped in molten steel A in the ladle 1 and the mixing vessel is sucked from the vacuum suction port 6 to obtain a vacuum condition. The pressure difference between the ladle 1 and the mixing vessel 2 becomes approximately 1 atm. and molten steel A is sucked up to the mixing vessel 2. (When the pressure difference is 1 atm., the suction height is approximately 1.48 m.) An inert gas such as Ar is fed to the molten steel ascending pipe 3 through the inert gas feeding pipe 5 to thereby lift up molten steel A to the mixing vessel 2 in accordance with the theory of an air lift pump.

When molten steel A reaches the point of the aforesaid suction height, excess molten steel A flows down to the ladle 1 through the descending pipe 4. In this manner, molten steel A is circulated between the ladle 1 and the mixing vessel 2, and gases such as $O_2$, $H_2$, $N_2$ and the like which dissolve in molten steel A are removed while molten steel A stays in the mixing vessel 2 as the mixing vessel 2 is maintained in a vacuum condition during this time. Alloy elements B are added to molten steel A in the mixing vessel 2 from the alloy element containing vessel 7. Thereafter, alloy elements B are mixed with molten steel A in the mixing vessel 2 then in the ladle 1, in which alloy elements B are uniformly dispersed into molten steel A by circulating molten steel A for a predetermined period of time.

However, this method causes some problems mentioned below due to the feeding of an inert gas, which are regarded as the principal difficulties for the practice of this method. An inert gas to be introduced to the ascending pipe 3 through the inert gas feeding pipe 5 appears over the surface of molten steel A in the mixing vessel 2 and is then exhausted toward the vacuum suction port 6. A part of alloy powder added from the alloy element containing vessel 7 also flows toward the vacuum suction port 6 together with the inert gas. Such an alloy powder adheres to an inner wall of the mixing vessel 2 or flows out of the mixing vessel 2 along the suction line. This results in the loss of a substantial amount of added alloy elements, so that an expected adjustment of molten steel composition can not be achieved. Further, alloy powder adheres to or accumulates in the suction line, which causes various problems such as a detrimental influence on the vacuum pump, from the view point of maintenance of attached apparatuses.

Furthermore, in the RH or DH method, the temperature of molten steel A gradually decreases while being circulated, and a dissolution rate of alloy elements also decreases extremely due to decrease of the temperature. Therefore, the time necessary for the adjustment of molten steel composition (time necessary for dissolving alloy elements in molten steel uniformly) can not be reduced even if the time necessary for circulation of molten steel is shortened.

There is an another method for lifting up molten steel from the ladle to the mixing vessel which utilizes a electromagnetic pump. This method adopts a power source having a low frequency of 0.9 to 16 cycles, therefore such is not expected to avoid the decrease of temperature of molten steel because such a low frequency does not produce an effect of heating molten steel as well as the RH or DH method. Further, specific consideration is not given to a descending flow of molten steel in this method, so that the efficiency of dissolution of alloy elements or degassing is still not improved and it will therefore take a great deal of time to complete an expected dissolution of alloy elements or degassing. Furthermore, as this method adopts the aforesaid specific low frequency, cost for electric power source becomes two or three times greater than that of an apparatus utilizing a commercial frequency. In summary, it will be difficult to perform this method on an industrial scale.

SUMMARY OF THE INVENTION

The inventors of the present invention put the above problems into consideration and thought it beneficial to utilize a linear motor so as to solve the problems which are especially accompained with the use of an inert gas. They vigorously proceeded with the research to improve an efficiency of treating molten steel. As the result, the following are recognized;

1. If a frequency of 50 to 60 cycles is adopted as a power source of a linear motor or induction coil, molten steel can be heated during the circulation of molten steel and the dissolution rate of alloy elements and a degassing efficiency can be improved to a great extent.

2. If alloy elements are added to molten steel which is lifted up to a treating vessel while being heated by the linear motor and molten steel is held in the treating vessel for a while, it is possible to dissolve alloy elements in molten steel with much better efficiency.

3. If a frequency of 50 to 60 cycles is adopted, a commercial power source can be used without any modification thereto. It also results in lightening the burden to an apparatus.

4. If a descending flow of molten steel from the treating vessel to the ladle is accelerated by a linear motor, it can be expected to agitate molten steel in the ladle effectively. A first feature of the present invention is that, upon treating molten steel by lifting up the same from a ladle to a treating vessel through at least one passage pipe connecting therebetween, subjecting molten steel to degassing and/or adjustment of molten steel composition then returning molten steel back to the ladle through at least one passage pipe, a linear motor is disposed around the aforesaid psassage pipe for ascending molten steel and the linear motor is operated with a frequency of 50 to 60 cycles whereby molten steel is circulated or reciprocated between the ladle and the treating vessel while be heated. A second feature of the present invention is that molten steel is held in the treating vessel for a preset time. A third feature of the present invention is that a descending flow of molten steel is accelerated by the linear motor when molten steel is returned back to the ladle from the treating vessel. A fourth feature of the present invention is that a nozzle is attached to a upper tip portion of the passage pipe to eject molten steel in the treating vessel.

Various other objects, features and attendant advantages of the present invention will be more fully appreciated as the same becomes better understood from the following detailed description when considered in connection with the accompanying drawings in which like reference characters designate like or corresponding parts through the several views and wherein:

DETAILED DESCRIPTION OF THE PREFERRED EMBODIMENTS

Figure 1:
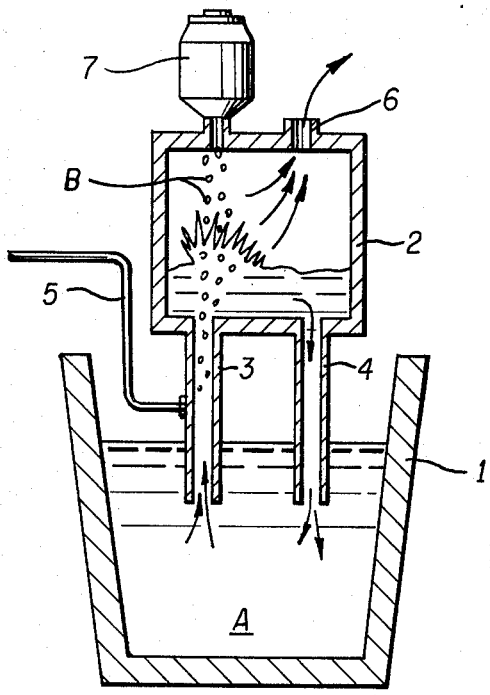
FIG. 1 PRIOR ART
FIG. 1 shows a sectional view of a conventional apparatus.

Referring to the drawings illustrating the embodiment of the present invention in the case of adjustemnt of molten steel composition, the present invention is explained hereinafter.

Figure 2:
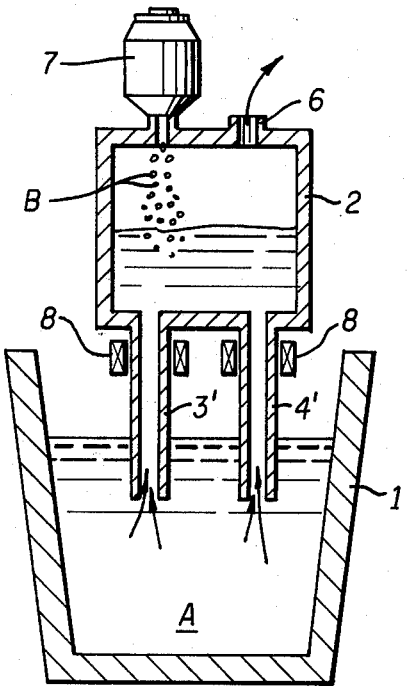
FIGS. 2 to 6 show sectional view of various apparatuses of the present invention.
Figure 3:
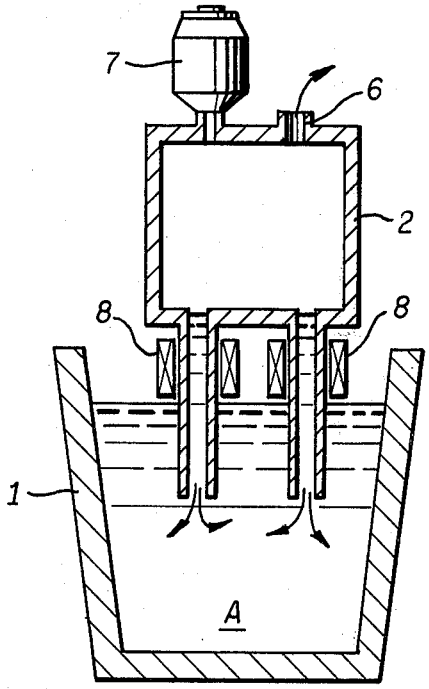

FIGS. 2 and 3 show sectional views of apparatuses performing adjustment of molten steel composition, the structure of which is almost the same as the one shown in FIG. 1. Provided in these apparatuses are linear motors or induction coils 8 disposed around passage pipes 3' and 4' at a proper positon thereof in which the linear motors 8 are operated with a frequency of 50 to 60 cycles. Molten steel A is lifted up to a mixing vessel 2 by a driving force of the linear motor 8 while being heated. While or after a present amount of molten steel A is being lifted up to the mixing vessel 2, alloy elements B are added to molten steel A from an alloy element containing vessel 7 (see FIG. 2). Then, molten steel A is held in the mixing vessel 2 for a preset time to mix alloy elements B with molten steel A, and thereafter, the operation of the linear motor 8 is ceased or the driving force of the linear motor 8 is directed downward to accelerate a descending flow of molten steel A. By this, molten steel A is returned back to the ladle 1 and is mixed with molten steel A resting in the ladle 1. Even after this operation is repeated up to addition of all the preset amount of alloy elements B to molten steel A, molten steel A is futher circulated or reciprocated between the ladle 1 and the mixing vessel 2 to obtain a uniform mixture of molten steel A and alloy elements B.

In the method according to the present invention, the driving force of the linear motor 8 is utilized to lift up molten steel A to the mixing vessel 2 instead of the use of an inert gas and therefore there is no possibility of the alloy powder adhering to the vicinity of the vacuum suction port 6 or flowing out of the mixing vessel 2 along the vacum suction line as in the conventional case of the embodiment shown in FIG. 1. Namely, all of added alloy elements B are mixed with molten steel A. Accordingly, an accurate adjustment of molten steel composition can be performed and, further, there is no possibility of causing an unexpected accident accruing from the invasion of alloy powder into a vacuum suction pipe, a vacuum pump or the like.

If the mixing vessel 2 is maintained in a vacuum condition, the degassing of molten steel A can be performed simultaneously with the adjustment of molten steel composition. However, it is not always necessary to maintain the mixing vessel 2 in the vacuum condition only upon performing the adjustment of molten steel composition because molten steel A can be well lifted up to the mixing vessel 2 by the driving force of the linear motor 8 even without a vacuum suction force in the method of the present invention. Depending on the situation, the adjustment of molten steel composition may be performed under such a condition that the mixing vessel 2 is maintained in the normal condition. In the case of performing the adjustment of molten steel composition in the normal condition, it is desirable to replace a gas in the mixing vessel 2 with an inert gas such as Ar to prevent an oxidation of molten steel A and alloy elements B.

Figure 4:
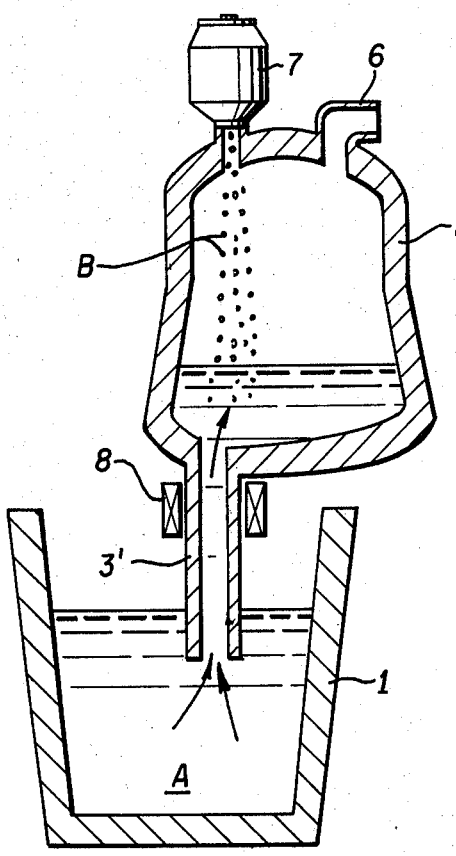
Figure 5:
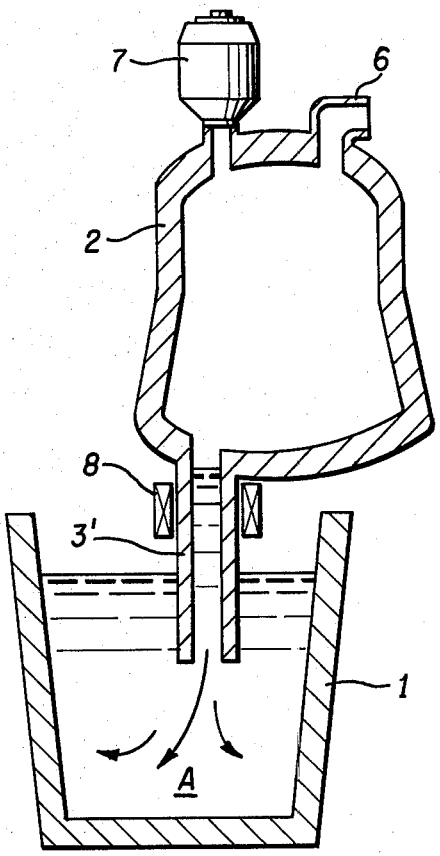

FIGS. 4 and 5 show another embodiment of the present invention. When molten steel ascends through one passage pipe 3', molten steel A is provided with a driving force and is heated by the linear motor 8. After alloy elements B are added to molten steel A in the mixing vessel 2, molten steel A is held in the mixing vessel 2 for a preset time then is returned back to the ladle 1 by stopping operation of the linear motor 8 or by changing the direction of the driving force of the linear motor downwardly. This operation is repeated to complete the adjustment of molten steel composition.

Figure 6:
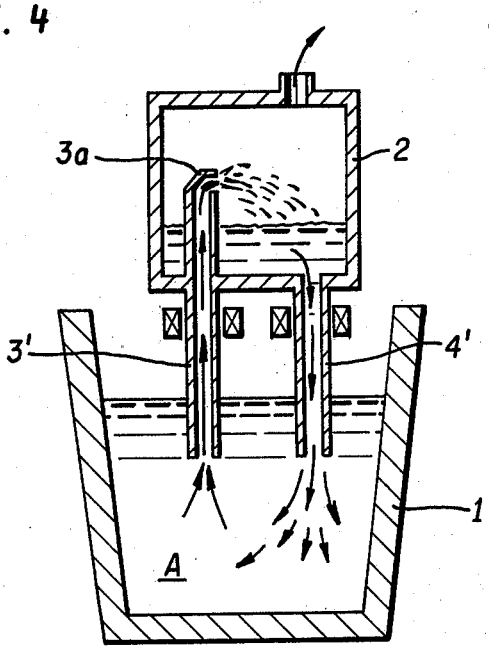

The molten steel passage pipe may be provided with a nozzle 3*a* at its extreme upper end portion as illustrated in FIG. 6. The ejection of molten steel from such nozzle provides an increased effective degassing area and an improved stirring effect, leading to an improved mixing efficiency of alloying elements and an higher degassing efficiency.

The present invention is constituted as described in the foregoing, effects of which are enjoyed upon practically performing the treatment of molten steel and are summarized hereinafter.

1. Molten steel is circulated or reciprocated while being heated by a linear motor in which a frequency to be adopted for the operation of the linear motor is set to be in the range of 50 to 60 cycles, whereby a dissolution rate of alloy elements is at the time kept high and the time necessary for completing the adjustment of molten steel composition can be therefore reduced to a great extent. For example, in the case that alloy elements are added to molten steel at a temperature of 1670° to 1680° C., if the temperature of molten steel is increased over 10° C. according to a method of the present invention, a dissolution rate of alloy elements becomes approximately twice and, on the contrary, the time for the complete adjustment of molten steel composition is reduced so as to be about half. If alloy elements are added to molten steel heated by the linear motor and molten steel is held in a mixing vessel for a present time (usually, 10 to 30 minutes), alloy elements almost completely dissolved in molten steel during this time to thereby shorten the treating time.

2. According to the method of the present invention, molten steel is returned to a ladle after alloy elements completely, dissolve in the molten steel. Therefore, it is expected to provide extremely uniform mixing of molten steel. In this case, if a descending flow of molten steel is accelerated by the linear motor, uniform mixing of molten steel can be provided more effectively.

3. Even in the case that degassing of molten steel is carried out simultaneously with the adjustment of molten steel composition, a high degree of vacuum status is maintained because the method of the present invention does not use an inert gas to lift up molten steel to the mixing vessel. Further, the adjustment of molten steel composition is performed more accurately because added alloy powder does not flow out of the mixing vessel along the vacuum suction line.

4. The time necessary for the circulation of molten steel is reduced as being accompanied by an increase in the ascending rate of the molten steel by use of the linear motor. Therefore, the time recquired for deaeration of molten steel is also reduced to be ½ to 174 as compared to DH or RH methods.

5. The method of the present invention utilizes a commercial frequency of 50 to 60 cycles as power source of the linear motor, and therefore it can reduce the cost for power source so as to be ½ to ⅓ as compared to a conventional method using a low frequency of 0.1 to 16 cycles.

Obviously, numerous modifications and variations of the present invention are possible in light of the above teachings. It is therefore to be understood that within the scope of the appended claims, the invention may be practiced otherwise than as specifically described herein.

What is claimed is:

1. A method for treating molten steel utilizing at least one induction coil, a ladle, a treating vessel and at least one passage pipe interconnecting said ladle and said treating vessel, which comprises:

positioning an induction coil around each of said passage pipes;

lifting up a part of said molten steel through each of said passage pipes from said ladel to said treating vessel disposed over said ladle through adjustment of molten steel composition in said treating vessel;

thereafter returning said molten steel to said ladle through each of said passage pipes;

circulating said molten steel between said ladle and said treating vessel while heating said molten steel by reversing direction of flow of said molten steel in each of said passage pipes by operation of each of said induction coils disposed around each of said passage pipes; and operating each of said induction coils at a frequency of 50 to 60 cycles.

2. A method for treating molten steel utilizing at least one induction coil, a ladle, a treating vessel and at least one passage pipe interconnecting said ladle and said treating vessel, which comprises:

lifting up a part of said molten steel from said ladle to said treating vessel disposed over said ladle through degassing;

thereafter returning said molten steel to said ladle through each of said passage pipes;

circulating said molten steel between said ladle and said treating vessel while heating said molten steel by reversing direction of flow of said molten steel in each of said passage pipes by operation of each of said induction coils disposed around each of said passage pipes; and operating said induction coil at a frequency of 50 to 60 cycles.

3. A method for treating molten steel utilizing at least one induction coil, a ladle, a treating vessel and at least one passage pipe interconnecting said ladle and said treating vessel, which comprises:

positioning an induction coil around each of said passage pipes;

lifting up a part of said molten steel from said ladle to said treating vessel disposed over said ladle through adjustment of molten steel composition in said treating vessel;

thereafter returning said molten steel to said ladle through each of said passage pipes;

reciprocating flow of said molten steel within each of said passage pipes between said ladle and said treating vessel while heating said molten steel by reversing direction of flow of said molten steel in each of said passage pipes by operation of each of said induction coils disposed around each of said passage pipes; and operating each of said induction coils at a frequency of 50 to 60 cycles.

4. The method as defined in claims 1, 2 or 3, which further comprises accelerating descending flow of said molten steel by each of said induction coils disposed around each of said passage pipes upon returning molten steel to said ladle through said passage pipes.

5. A method as defined in claims 1, 2 or 3, which further comprises holding said molten steel in said treating vessel for a preset time.

6. A method as defined in claims 1, 2 or 3, which further comprises ejecting molten steel lifted up to said treating vessel through each of said passage pipes over a surface of molten steel in said treating vessel.

7. Apparatus for treating molten steel, comprising:

a ladle for containing molten steel;

a treating vessel disposed over said ladle;

at least one passage pipe connecting said ladle with said treating vessel; and an induction coil disposed around each of said passage pipes operated with a frequency of 50 to 60 cycles for generating reversible flow of molten metal within each of said passage pipes to and from said treating vessel.

8. An apparatus as defined in claim 7, said treating vessel furthe comprising a port formed therein for addition of alloy elements.

9. An apparatus as defined in claim 7, further comprising vacuum degassing means operatively associated with said treating vessel.

10. An apparatus as defined in claim 7, each of said passage pipes projecting into said treating vessel and further comprising a nozzle attached to a tip portion of at least one of said passage pipes.

* * * * *